United States Patent [19]

Longhouse

[11] 3,937,192

[45] Feb. 10, 1976

[54] EJECTOR FAN SHROUD ARRANGEMENT

[75] Inventor: Richard E. Longhouse, Rochester, Mich.

[73] Assignee: General Motors Corporation, Detroit, Mich.

[22] Filed: Sept. 3, 1974

[21] Appl. No.: 502,276

[52] U.S. Cl. ..... 123/41.49; 123/41.58; 123/41.66; 165/51; 415/DIG. 1

[51] Int. Cl.[2] ..... F01P 7/10

[58] Field of Search ..... 123/41.58, 41.66, 41.65, 123/41.48, 41.49; 165/51; 415/2, 4, DIG. 1

[56] References Cited

UNITED STATES PATENTS

| | | | |
|---|---|---|---|
| 3,842,902 | 10/1974 | Poslusny | 123/41.49 |
| 3,854,459 | 12/1974 | Stimeling | 123/41.49 |
| 3,858,644 | 1/1975 | Beck | 123/41.49 |

FOREIGN PATENTS OR APPLICATIONS

| | | | |
|---|---|---|---|
| 24,750 | 6/1922 | France | 415/4 |
| 1,007,883 | 2/1952 | France | 415/4 |
| 866,053 | 3/1941 | France | 415/DIG. 1 |

*Primary Examiner*—Wendell E. Burns
*Assistant Examiner*—Daniel J. O'Connor
*Attorney, Agent, or Firm*—John P. Moran

[57] ABSTRACT

An engine cooling arrangement embodying a single fan and various embodiments of dual concentric shrouds associated therewith for producing an ejector action for substantially diminishing recirculation of the air flow.

5 Claims, 5 Drawing Figures

EJECTOR FAN SHROUD ARRANGEMENT

This invention relates generally to automotive engine cooling fans and, more particularly, to ejector shroud arrangements therefor.

It is known generally that minimal clearance between the tips of the blades of an engine cooling fan and its associated shroud serves to provide more efficient fan operation to reduce fuel consumption and/or to minimize attendant fan noise. However, some difficulty is encountered in shrouding the fan to provide for such minimum clearance without causing inlet air-flow separation, particularly in view of the shroud having to change from a generally square or rectangular shape at the end thereof which is secured to the radiator, to a circular shape adjacent the tips of the fan blades in the inherent short distance between the usual radiator core and the adjacent fan.

Accordingly, a general object of the invention is to provide an improved engine cooling fan and associated dual shroud arrangement which provides for efficient fan operation with minimal resultant fan noise.

Another object of the invention is to provide an improved cooling fan and associated shroud arrangement wherein, in one embodiment, dual concentric shrouds are employed which eliminate the necessity of employing a close-fitting shroud, the fan serving as the core of an ejector system.

Still another object of the invention is to provide an alternate cooling fan and associated dual concentric shroud embodiment, wherein minimal blade-tip clearance is adhered to, but wherein an entrained air-flow is accomplished via the predetermined space between the inner and outer shrouds.

These and other objects and advantages of the invention will be apparent when reference is made to the following description and accompanying drawings, wherein.

Figure 1:
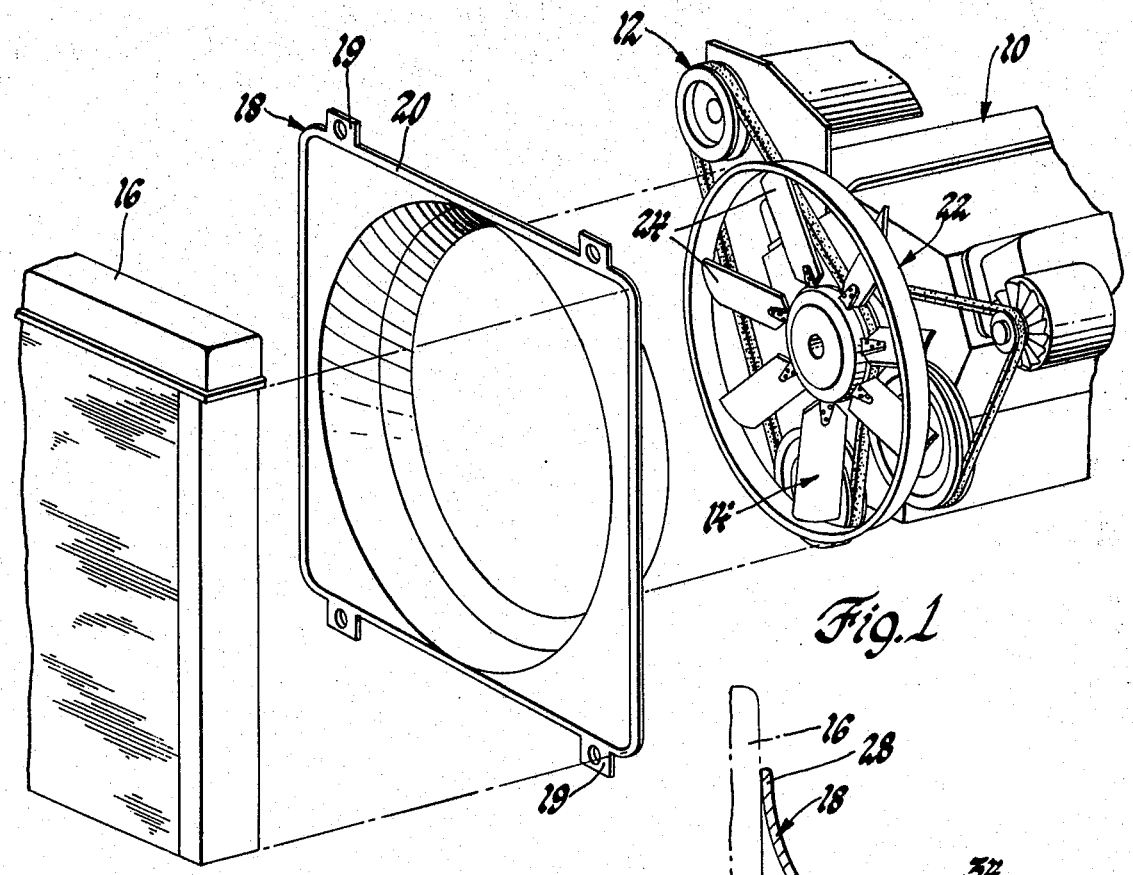
FIG. 1 is an exploded perspective view of an automotive radiator, engine and engine cooling fan and shroud arrangement embodying the invention.

Referring now to the drawings in greater detail, FIG. 1 illustrates an automotive engine 10 having the usual belt and pulley arrangement 12 associated with the forward end thereof for driving the usual accessories, including an engine cooling fan 14. A radiator 16 is located adjacent the cooling fan 14, with an outer fan shroud 18 connected by mounting brackets 19 at a generally rectangular-shaped face 20 thereof adjacent the perimeter of the radiator 16. An inner fan shroud 22 is secured to the outer tips of the blades 24 of the fan 14.

Figure 2:
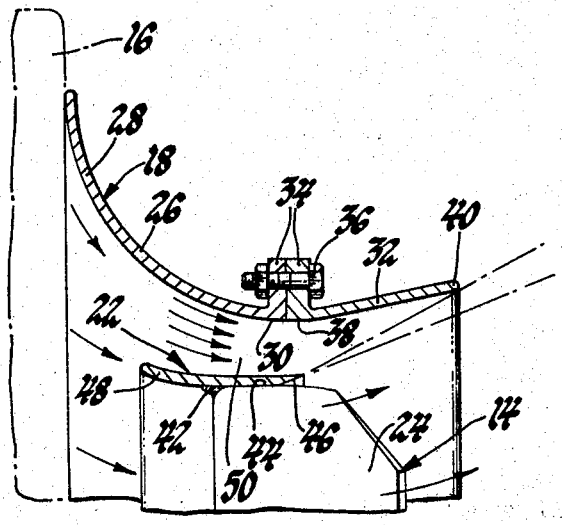
FIG. 2 is a fragmentary cross-sectional view of the fan and shroud portion of FIG. 1.

As may be noted by referring to FIG. 2, the outer shroud 18 includes an arcuate-shaped cross-sectional wall section 26 which extends from a large circular end-configuration 28, formed at the rectangular-shaped shroud face 20, to a smaller circular end-configuration 30 located radially adjacent the outer tips of the blades 24. A generally conically-shaped shroud extension 32 is secured by mounting flanges 34 and bolts 36 at the small end 38 thereof to the smaller end 30 of the outer shroud 18, with the large distal end 40 thereof terminating at a predetermined plane intermediate the fan 14 and the forward end of the engine 10.

The inner shroud 22 is generally circular in shape and is secured to the outer tips of the blades 24 in any suitable manner, such as by welding at an intermediate point 42 along the inner periphery thereof, such that a predetermined portion 44 of the length of the outer tips of each fan blade 24 is abutted against the inner surface as substantially one-half of the length of the inner shroud 22. The rearward or exiting end of the attached portion of the shroud 22 is formed to include an annular chamfer or diffuser 46. The free or inlet end-portion of the shroud 22 is formed to include an arcuate-shaped end-portion 48, flaring slightly outwardly at the edge thereof.

It may be noted in FIG. 2 that the resultant annular clearance 50 between the inner and outer shrouds 22 and 18, respectively, is relatively wide, say, on the order of ¾-inch, for a conventional larger type of automotive fan.

OPERATION

Air-flow through the radiator 16 moves rearwardly, in part being drawn through the fan blades 24, and in part being entrained along the inner surface of the wall section 26 of the outer shroud 18. The latter air movement proceeds through the annular clearance 50 between the inner and outer shrouds 22 and 18, respectively, such that an annular ejector-type mixing region, having diverging conical-shaped outer and inner peripheries, occurs intermediate the outlet ends of the inner shroud 22 and the outer shroud extension 32. As illustrated by dash-dot lines in FIG. 2, the outer periphery of the mixing region is along the angle of the diffuser 46 and extending to the distal end 40 of the shroud extension 32, with the inner periphery of the mixing region extending from the chamfer 46 to a circular position radially inwardly of the end 40.

Accordingly, as a result of the ejector action, any tendency of the air-flow to recirculate around the outer tips of the fan blades 24 is substantially diminished, i.e., the high-pressure flow produced by the fan 14 is prevented from escaping around the fan blade-tips back to the low-pressure side intermediate the fan 14 and the radiator 16. Thus, the effective size of the fan 14 is increased, enabling the fan to be operated at a reduced speed, thereby correspondingly reducing the resultant fan noise.

FIG. 3 Embodiment

Figure 3:
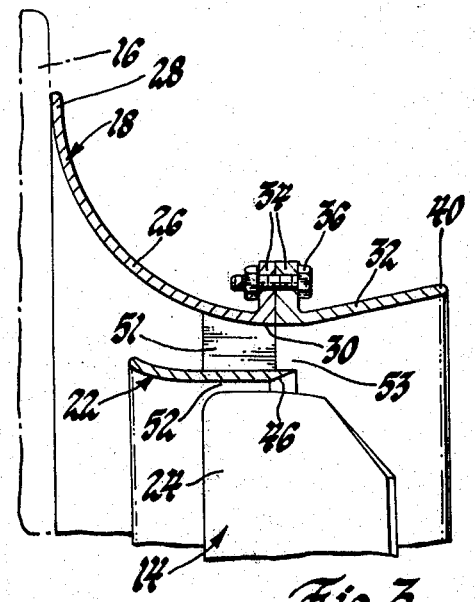
FIGS. 3, 4, and 5 are fragmentary cross-sectional views of three alternate embodiments of the invention.

Referring now to FIG. 3, an alternate embodiment to the FIG. 2 structure, it may be noted that the inner shroud 22 is rigidly connected by means of a plurality of circumferentially spaced struts 51 to the inner surface of the outer shroud 18 adjacent the smaller end-portion 30 thereof, such that a minimal clearance 52 exists between the inner surface of the inner shroud 22 and the tips of the blades 24, while a substantially larger clearance 53 exists intermediate the shrouds 18 and 22. The resultant ejector action of the diffuser 46 is comparable to that discussed above relative to the FIG. 2 arrangement.

FIG. 4 Embodiment

Figure 4:
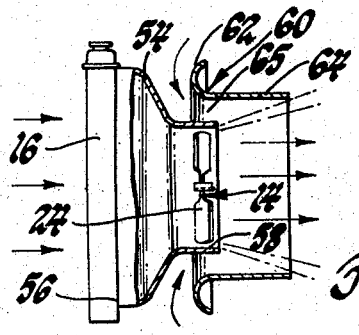

Still another alternate arrangement is illustrated in FIG. 4. In this embodiment the inner shroud 54 is a substantially conventional shroud, i.e., it is formed to include a square or rectangular face 56 at one end thereof for mounting adjacent the outer periphery of the radiator 16. The shroud 54 is additionally formed to progressively vary from the square or rectangular end-face 56 to a smaller circular end-portion 58 closely fitted around the outer tips of the fan blades 24 in the conventional manner. A fixed outer shroud 60 is formed to include a toroidal-shaped end-portion 62 at the inlet end thereof located radially outwardly of the fan 14 and the inner shroud end-portion 58. The shroud 60 also includes a cylindrical portion 64 extending rearwardly from the end-portion 62, providing a clearance 65 intermediate the shrouds 54 and 60. Once again, the combination of the air-flow drawn through the fan 14, within the closely fitted inner shroud 54, and the entrained air-flow through the clearance 65 between the respective inner and outer shrouds 54 and 60 provides an ejector action intermediate the rearward ends of the respective inner and outer shrouds 54 and 60, serving to effectively diminish air-flow recirculation back around the fan blade tips and/or around the end-portion 58 of the inner shroud 54. In this instance, the entrained air-flow is not being pulled through the radiator 16. A chamfer or diffuser [not shown] may be formed on the rearward edge of the circular shroud end-portion 58.

FIG. 5 Embodiment

Figure 5:
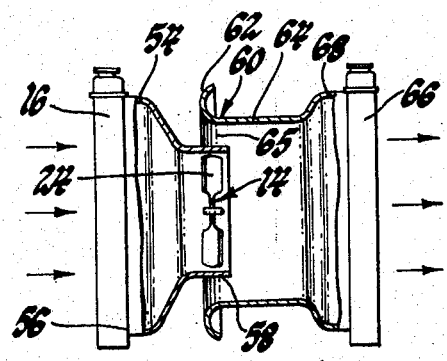

The additional alternate arrangement illustrated in FIG. 5 embodies a tandem radiator concept, wherein a second radiator 66 is axially aligned with the forward radiator 16, and wherein a circular-to-rectangular transitional shroud section 68 interconnects between the cylindrical portion 64 of the outer ejector shroud 60 and the square or rectangular outer periphery of the second radiator 66. By virtue of such an ejector fan arrangement causing a part of the fan dynamic pressure, or velocity head, which is normally dumped and lost in a single radiator arrangement, to be converted to a static pressure, losses normally encountered at the second radiator 66 are thus offset and the conventional single fan 14 will suffice without having to add a second fan. The resultant ejector action between the fan 14 and the outer shroud section 68 is similar to that described above with respect to the FIG. 4 structure.

It should be apparent that the dual concentric fan shroud arrangements serve to effectively provide an ejector action extending between the respective rearwardmost shroud-ends thereof for substantially diminishing air-flow recirculation around the outer tips of the fan blades to the low-pressure area intermediate the fan and the adjacent radiator. Accordingly, with the fan air-flow augmented by the secondary entrained air-flow through the clearance between the shrouds, the effective size of the fan is increased, thus providing for a reduced fan speed and, correspondingly, reduced fan noise.

While several species of a general dual fan shroud arrangement have been shown and described, other modifications thereof are possible.

I claim:

1. An automotive engine cooling means for use intermediate a radiator and an engine, said cooling means comprising a fan having a plurality of fan blades and being operatively connected to and driven by said engine, and concentric inner and outer fan shrouds, each mounted so as to have a portion thereof positioned radially outwardly of said fan with said outer shroud extending a predetermined distance past said fan toward said engine, one of said shrouds having a rectangular-shaped face formed on an end thereof and secured to said radiator with the other end thereof being circular-shaped, and the other of said shrouds being cylindrically-shaped and secured to one of said fan at the outer tips of said fan blades thereof, said other shroud, and a separate fixed abutment, providing a clearance of a predetermined width intermediate said inner and outer shrouds, the air drawn through said fan and the air entrained through said clearance between said shrouds terminating in an ejector action extending from the engine end of said inner shroud to the engine end of said outer shroud, said ejector action serving to substantially diminish air-flow recirculation around the outer tips of said fan blades to the low-pressure area intermediate the fan and the radiator.

2. An automotive engine cooling means for use intermediate a radiator and an engine, said cooling means comprising a fan having a plurality of fan blades and being operatively connected to and driven by said engine, and concentric inner and outer fan shrouds, each mounted so as to have a portion thereof positioned radially outwardly of said fan with said outer shroud extending a predetermined distance past said fan toward said engine, said outer shroud having a rectangular-shaped face formed on one end thereof and secured to said radiator with the other end thereof being circular-shaped, and said inner shroud having a diffuser formed at the engine end thereof and being secured to said fan blades at the outer tips thereof, the air drawn through said fan and the air entrained through the clearance between said shrouds terminating in an ejector action extending from the engine end of said inner shroud to the engine end of said outer shroud, said ejector action serving to substantially diminish air-flow recirculation around the outer tips of said fan blades to the low-pressure area intermediate the fan and the radiator.

3. An automotive engine cooling means for use intermediate a radiator and an engine, said cooling means comprising a fan having a plurality of fan blades being operatively connected to and driven by said engine, and concentric inner and outer fan shrouds, each mounted so as to have a portion thereof positioned radially outwardly of said fan with said outer shroud extending a predetermined distance past said fan toward said engine, said outer shroud having a rectangular-shaped face formed on one end thereof and secured to said radiator with the other end thereof being circular-shaped, and said inner shroud being substantially cylindrically-shaped and having a diffuser formed at the engine end thereof and being secured to said outer shroud via equallyspaced struts connected therebetween, providing minimal clearance between said inner shroud and the outer tips of said fan blades, the air drawn through said fan and the air entrained through the clearance between said shrouds terminating in an ejector action extending from the engine end of said inner shroud to the engine end of said outer shroud, said ejector action serving to substantially diminish air-flow recirculation around the outer tips of said fan blades to the low-pressure area intermediate the fan and the radiator.

4. An automotive engine cooling means for use intermediate a radiator and an engine, said cooling means comprising a fan having a plurality of fan blades and being operatively connected to and driven by said engine, and concentric inner and outer fan shrouds, each mounted so as to have a portion thereof positioned radially outwardly of said fan with said outer shroud extending a predetermined distance past said fan toward said engine, said inner shroud having a rectangular-shaped face formed on one end thereof and secured to said radiator and having the other end thereof circular-shaped and providing minimal clearance between the inner surface thereof and the outer tips of said fan blades, and said outer shroud being cylindrically-shaped, having a toroidal inlet formed at its radiator end and being secured at its engine end to a separate fixed abutment, the air drawn through said fan and the air entrained through the clearance between said shrouds terminating in an ejector action extending from the engine end of said inner shroud to the engine end of said outer shroud, said ejector action serving to substantially diminish air-flow recirculation around the outer tips of said fan blades to the low-pressure area intermediate the fan and the radiator.

5. An automotive engine cooling means for use intermediate a pair of spaced radiators and located forward of and aligned with an engine, said cooling means comprising a fan having a plurality of fan blades and being operatively connected to and driven by said engine, and concentric inner and outer fan shrouds, each mounted so as to have a portion thereof positioned radially outwardly of said fan with said outer shroud extending a predetermined distance past said fan toward said engine, said inner shroud having a rectangular-shaped face formed on one end thereof and secured to said forwardmost radiator and having the other end thereof circular-shaped and providing minimal clearance between the inner surface thereof and the outer tips of said fan blades, and said outer shroud being cylindrical-shaped, having a toroidal-shaped inlet formed at its forward end and a progressively varying circular-to-rectangular transition section formed at its rearward end and being secured at its rectangular end to said rearwardmost radiator, the flow drawn through said fan and the flow entrained through the clearance between said shrouds terminating in an ejector action extending from the engine end of said inner shroud to said transition section of said outer shroud, said ejector action serving to convert some of the fan dynamic pressure to static pressure, thereby offsetting the losses encountered at said rearwardmost radiator.

* * * * *